United States Patent [19]

Furbee

[11] 4,315,182

[45] Feb. 9, 1982

[54] FROSTED X-RAY TUBE

[75] Inventor: Avery D. Furbee, Elmhurst, Ill.

[73] Assignee: Picker Corporation, Cleveland, Ohio

[21] Appl. No.: 829,650

[22] Filed: Sep. 1, 1977

[51] Int. Cl.[3] ..... H01J 35/10

[52] U.S. Cl. ..... 313/59; 313/60; 313/116; 65/31

[58] Field of Search ..... 313/116, 59, 55, 58, 313/60; 65/31

[56] References Cited

U.S. PATENT DOCUMENTS 754,251 3/1904 Steinmetz ..... 313/116 X 958,488 5/1910 Green ..... 313/59

*Primary Examiner*—Palmer C. Demeo

*Assistant Examiner*—Darwin R. Hostetter

*Attorney, Agent, or Firm*—Watts, Hoffmann, Fisher & Heinke Co.

[57] ABSTRACT

The inner surface of an X-ray tube envelope is constructed to prevent the build-up of an electrically conductive layer of metal deposits on the tube envelope in the regions adjacent to and between the cathode focusing element and the anode. In the disclosed embodiment this area is textured so that metal deposits can only collect in certain places and not in others. The places of metal collection are spaced so that the development of a conductive metal layer is inhibited. By properly texturing the inner surface of the envelope, this spaced collection of metal is so effective that the spaced regions of metal build-up are electrically insulated from one another. A method is disclosed comprising first mechanically abrading the inner surface of the envelope to create small fracture regions. Thereafter, the abraded surface is acid-etched. The acid attacks the areas of the envelope which exhibits these fracture regions creating relatively deep and narrow "canyons" surrounding "islands". The canyons are of such steepness and depth that the trajectory of particles of metal released from tube elements do not form conductive layers in the canyons.

13 Claims, 6 Drawing Figures

FROSTED X-RAY TUBE

BACKGROUND OF THE INVENTION

1. Field of the Invention

The invention relates to X-ray tubes and, more particularly, to an X-ray tube having means to control the harmful build-up of metal deposits on the inner surface of the X-ray tube.

2. Description of the Prior Act

A conventional X-ray tube has an evacuated envelope which houses spaced anode and cathode assemblies. Typically, the cathode assembly includes a thermionic filament. When the tube is in use an electric current is passed through the filament to heat it and develop a "cloud" of electrons around it. When a high tension potential is applied across the assemblies a flow of electrons from the filament bombards the anode causing it to emit X-rays.

The high temperature, high potential conditions which exist when an X-ray tube is in use cause particles of the filament material to be evaporated. Under ideal conditions the X-ray will continue to function properly until the filament "burns out". That is, the tube will continue to function properly until so many particles have been evaporated from the filament that it is weakened to the point where it can no longer support its own weight and it breaks.

Many X-ray tubes fail prematurely due to voltage instabilities that develop in the tube. That is, these voltage instabilities cause tube failure before the filament has "burned out". It has been determined that a cause of these voltage instabilities is metal deposits on the walls of the envelope which gradually develop as the filament, and to a certain degree other components such as the anode of the X-ray tube, release metal particles during use.

A portion of that part of the X-ray tube envelope in the region between the cathode focusing element and the anode of the X-ray tube develops a negative charge during use. This negative charge contributes to proper tube operation in that it helps the electron beam land at the focal spot of the target, prevents excessive electrons from backscattering on to the envelope between the cathode focusing element and the anode, and thus prevents over heating of the envelope in this region. This negative charge also assures that spurious ions are properly collected or diverted in such a manner as to not build up excessive charges on the envelope, in particular in regions opposite the cathode structure where excessive charge build up can cause flash overs that can destroy the tube.

It has been discovered that when certain common and practical dimensional trade offs in an X-ray tube are made, a major cause of voltage instabilities occurs when metal deposits in the region adjacent to and between the cathode focusing element and the anode. When sufficient metal deposition occurs to form a conductive layer in this area, voltage instabilities result because the normal charge distribution described above in the region generally between the cathode focusing element and anode is changed by the conductive metal layer. Once this desired charge distribution is lost, the X-ray tube becomes erratic and will not produce images of appropriate quality or a system of proper reliability. As a consequence the tube must be considered to have failed prematurely.

One commercial solution to this voltage instability problem has been the provision of an X-ray tube which has a tubular metal central portion and glass end portions which are sealed to the central portion. The metal portion is kept at constant potential to avoid the voltage instability problems. It is more difficult to fabricate and to process and view the internal parts of this tube during processing. Furthermore the subsequent alignment of the tube in its enclosure is more difficult than is the case with a glass envelope type since there is no means to visually align the focal spot with respect to the tube housing. For these reasons it is much more expensive to manufacture.

Other possible solutions might consist of making the glass bulb larger; thus increasing cathode anode distances to the glass walls. This solution has the obvious disadvantage of making the X-ray tube and in particular its oil filled enclosure larger and heavier.

Various techniques have been used to modify the physical characteristics of the glass envelope. Among these are the proposal of U.S. Pat. No. 958,488 for frosting the window area of an X-ray tube to create a "cellular portion". It is doubtful whether this frosting will effect the advantages claimed for it by the patent and certainly it would not have an effect on the described voltage instability problem.

Commercial X-ray tubes manufactured by the General Electric Company have had a modified glass etching procedure performed on them in areas other than the region between the cathode focusing element and anode. While the procedure used by General Electric has, it is believed, been maintained as a trade secret, it is thought to be achieved by first abrading the glass and etching the glass.

SUMMARY OF THE INVENTION

The inner surface of an X-ray tube envelope is constructed to prevent the build-up of an electrically conductive layer of metal deposits on the tube envelope in the regions adjacent to and between the cathode focusing element and the anode. In the disclosed embodiment this area is textured so that metal deposits can only collect in certain places and not in others. The places of metal collection are spaced so that the development of a conductive metal layer is inhibited. By properly texturing the inner surface of the envelope, this spaced collection of metal is so effective that the spaced regions of metal build-up are electrically insulated from one another.

The preferred method to produce the improved tube comprises first mechanically abrading the inner surface of the envelope to create small fracture regions and then acid-etching the abraded surface. The acid attacks the areas of the envelope which exhibit these fracture regions thus creating relatively deep and narrow "canyons" surrounding "island". The canyons are of such steepness and depth that the trajectory of particles of metal released from tube elements do not form conductive layers in the canyons.

DESCRIPTION OF THE PREFERRED EMBODIMENT

Figure 1A:
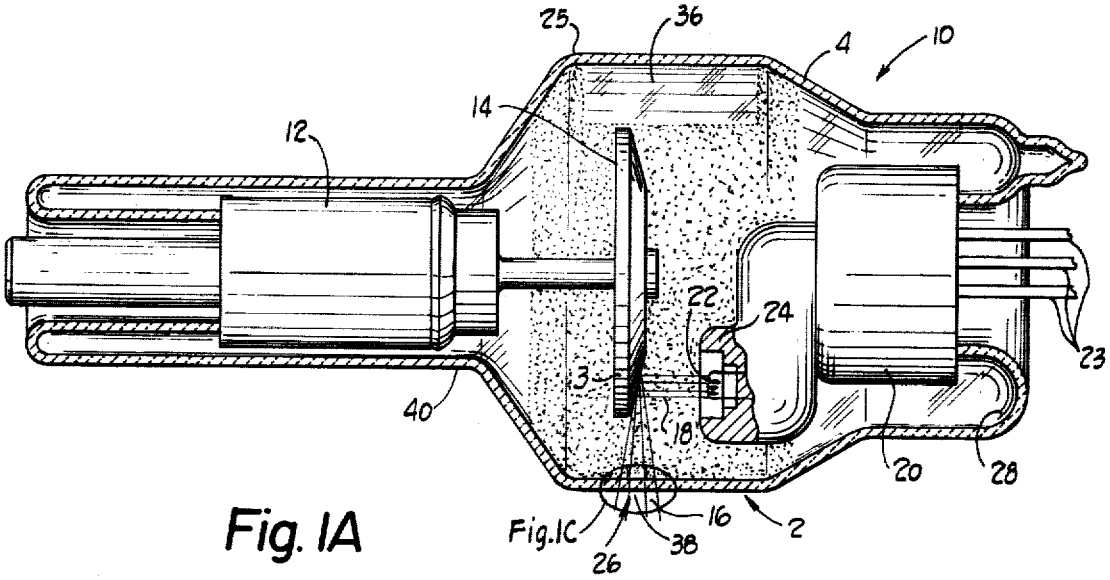
FIG. 1A is a cross-sectional view of an X-ray tube embodying the present invention.
Figure 1B:
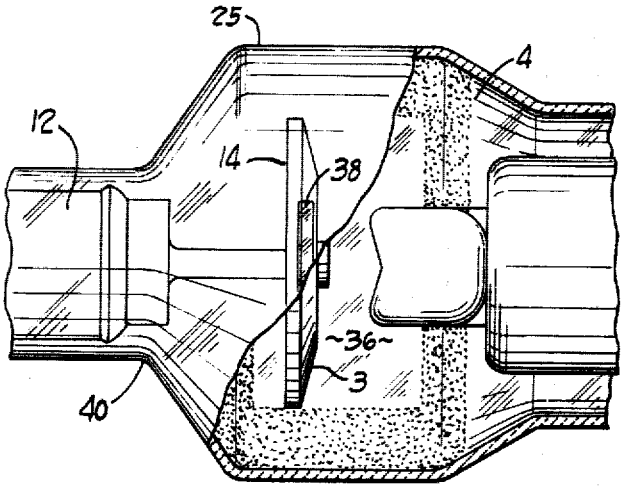
FIG. 1B is another view emphasizing the approximate area that is textured.

An X-ray tube 10 as shown in FIG. 1A with a detail illustrating the approximate frosted area in FIG. 1B. The tube 10 includes a rotatable anode 12 having a disc-like target 14. The target 14 is comprised of a material such as tungsten adapted to emit X-rays indicated at 16 in response to the impingement of electrons indicated at 18.

The tube 10 also comprises a cathode 20 having a filament 22 adapted to be heated electrically via leads 23 so that electrons may surround the filament in a so-called cloud. The electrons then may flow from the filament 22 to the target 14 upon the attainment of a sufficient potential difference between the cathode 20 and the anode 12. A cathode cup 24 focuses the electrons into a beam. This focus is essential if the X-rays which are emitted are to produce images with the desired resolution. Electrical circuitry to carry out these functions is conventional and need not be shown.

The foregoing components are housed within an evacuated glass envelope 25. The envelope 25 includes a window area 26 through which x-rays emitted by the target portion may pass outwardly of the tube. A flashed getter layer 28 is provided within the envelope at a location near the cathode.

Figure 1C:
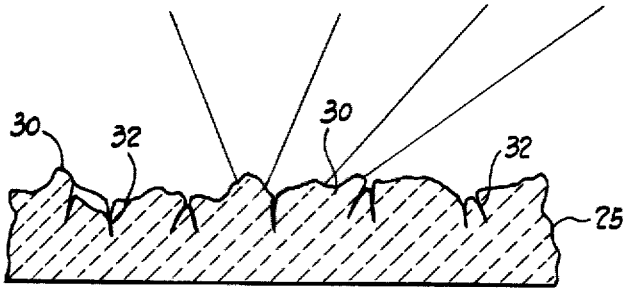
FIG. 1C is a schematic representation of the textured area of FIG. 1A and 1B in cross-section illustrating the texture.
Figure 2:
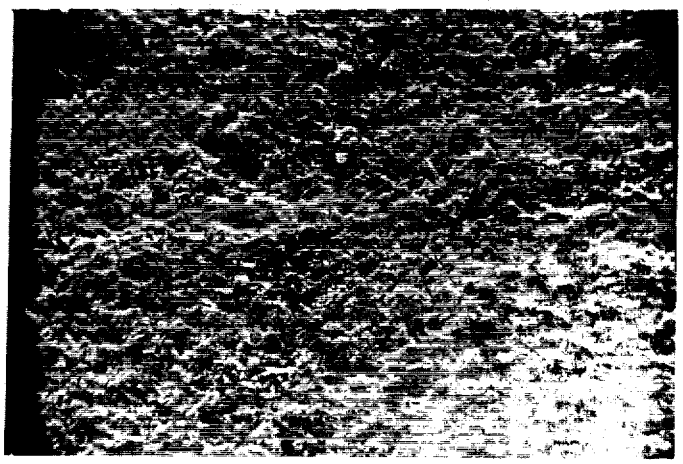
FIG. 2 is a view taken of the textured area of the tube envelope according to the invention magnified 200 times.
Figure 3:
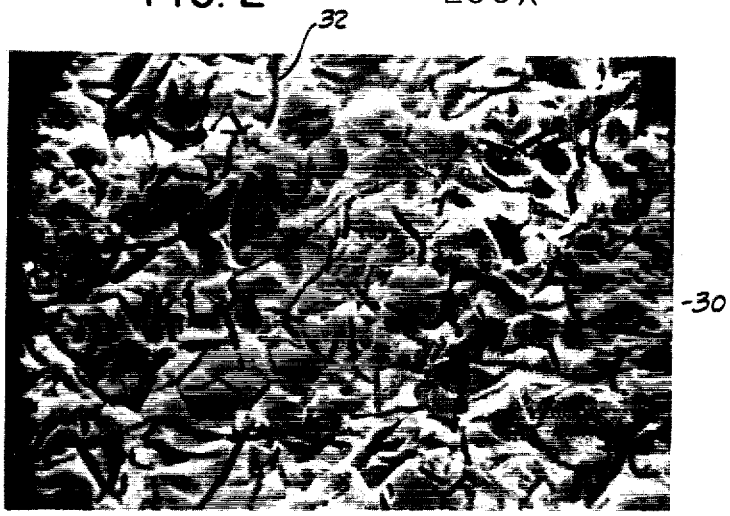
FIG. 3 is a view similar to FIG. 2, but magnified 1,000 times.
Figure 4:
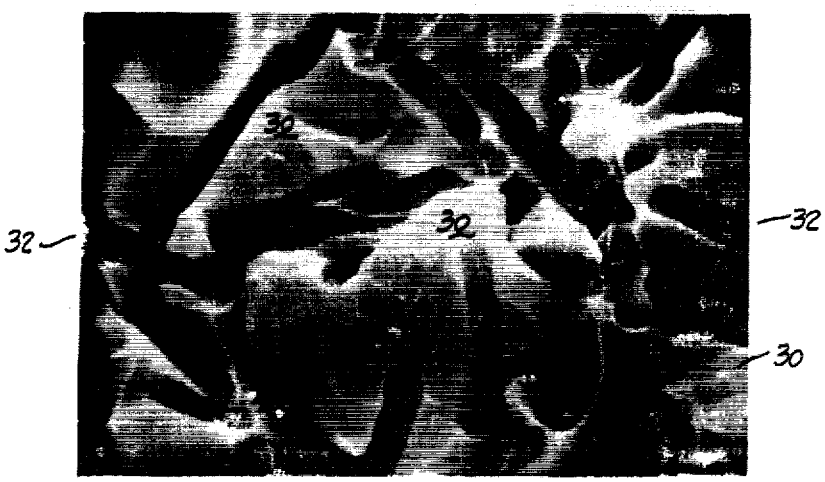
FIG. 4 is a view similar to FIGS. 2 and 3 but magnified 5,000 times.

In order to alleviate the problems arising from accumulation of the metal particles in the region 2, this area is textured on its inner surface. This is indicated in FIG. 1C. The inner surface of the window is comprised of a plurality of randomly disposed islands 30 and a plurality of canyons 32 intermediate the islands. The canyons are very narrow and deep and include near-vertical walls. By this construction, it is extremely unlikely that metal particles will form a conductive layer on the inside of the tube envelope in the regions adjacent to and between the focusing element and the anode and, hence, deleterious voltage instabilites will not occur. This is so because it is very unlikely that a given particle will approach any portion of the window area at a trajectory sufficient to permit the particle to find its way to the bottom of the canyon. FIG. 1C illustrates this schematically. Accordingly, it will be difficult for the particles to accumulate within the canyons and, further, until this occurs, the envelope will be able to perform its intended function. That is, the particles will accumulate atop the islands 30 and the slopes approaching the islands, but the unfilled canyons 32 will prevent electrical conduction between these spaced areas of metal accumulation.

A particularly successful technique for manufacturing an X-ray tube in accordance with the present invention has been found. The textured window area is created first by mechanically abrading the smooth inner surface of the envelope through the impingement of particulate matter. Grit of fine to very fine grade is sufficient for this purpose, for example series 220 or 280 aluminum oxide grit. The grit may be directed to the desired area of the tube in a known manner by a hand-held nozzle pressurized on the order of 15 to 60 pounds per square inch gauge. The mechanical abrasion creates small fracture regions in the envelope where the particulate matter impacts and abrades the envelope.

The envelope next is acid-etched so that the fracture areas are attacked by the acid. Although the particular theory of operation may not be fully understood, it is believed that the acid removes more material in the fracture areas and less material in the areas of no or lesser fracture. A weak solution of hydrofluoric acid, for example 0.5% HFl, has been found appropriate for this purpose when applied for approximately 1 ½ hours. The hydrofluoric acid solution most advantageously is very weak so that etching is done very slowly. By this approach, a greater margin of error with respect to etching time is possible and damage to the envelope can be avoided without too critical control over etching time.

In order to minimize manufacturing expense, speed assembly, and provide the maximum benefit of the texturing, the entire inner surface of the envelope 25 may be texturized with several exceptions:

1. A viewing area indicated at 36 which permits viewing the interior of the tube during vacuum-pumping operations.
2. A narrow slit indicated at 38 which permits an assembler to align the focal spot which appears on the beveled portion of the anode 14 at 3 during placement of the X-ray tube in its oil filled housing.
3. The neck of the tube indicated at 40 and the cathode region from the point marked 4 to the cathode end of the envelope in those tubes where the neck and cathode region is heat-softened and worked after insertion of tube components. Heat-softening in the neck and or cathode region removes the texture and texturizing. The areas where texturing is not desired may be created by masking the appropriate location with tape prior to grit blasting and acid-etching. An example of this is region 38.

Results obtained in tests of X-ray tubes employing the present invention have been significant. For all practical purposes, the effects of build-up of metal deposits from the filament of the X-ray tube on the inner surface of the envelope has been eliminated as a problem because none of the x-ray tubes tested by the applicant have failed in this regard. The present invention, then, provides an inexpensive, readily available solution to the problem of metal build-up in x-ray tubes.

While a specific embodiment of the invention has been described, it will be apparent to those skilled in the art that changes and modifications may be made without departing from the invention. It therefore is intended in the appended claims to cover all such changes and modifications that fall within the true spirit and scope of the invention.

I claim:

1. An X-ray tube comprising:

(a) an evacuated envelope formed of electrically insulating, X-ray transmissive material;

(b) a cathode assembly mounted in the envelope;

(c) an anode assembly mounted in the envelope in spaced relationship with the cathode;

(d) the anode assembly including a target area of a material which will emit a beam of X-rays along a beam path when the area is bombarded by a flow of electrons from the cathode;

(e) said envelope including an X-ray window portion along the beam path; and (f) the tube including textured interior surfaces in envelope regions including at least portions of the window and adjacent to and between the cathode focusing element and the anode to isolate collections of metallic particles from the assemblies into small areas which are each conductively isolated from other of such collections such that such particles do not develop a conductive layer of metal in the envelope regions whereby substantially to avoid premature tube failure due to the electrical conductivity of metal deposits.

2. The article of claim 1, wherein the textured surface is created in part by the impingement of particulate matter.

3. A rotating anode X-ray tube comprising:

(a) an evacuated glass envelope;

(b) an anode drive motor mounted in the envelope near one end;

(c) a disc-like anode mounted on the motor for rotation when the motor is energized, the anode including an endless target;

(d) a thermionic filament mounted in the envelope near its other end and positioned to emit a stream of electrons against a portion of the target to cause the anode to emit a beam of X-rays through a window area; and (e) an envelope region adjacent to and between the cathode focusing element and the anode having a plurality of relatively deep and narrow internal grooves of sufficient narrowness and depth that the trajectory of metal particles liberated by the filament and striking the envelope in the window area is such that the accumulation of the particles into a conductive layer in the bases of at least some of the grooves is prevented whereby to inhibit the development of a conductive metal layer in the envelope regions adjacent to and between the cathode focusing element and the anode which would cause premature tube failure.

4. The article of claim 3, wherein the grooves are created in part by the impingement of particulate matter.

5. An X-ray tube, comprising:

(a) an evacuated envelope;

(b) a cathode disposed within the envelope, the cathode adapted to emit electrons when energized;

(c) an anode disposed within the envelope, the anode being positioned to be impinged by electrons emitted from the cathode and adapted to emit X-rays in response to the impingement of electrons;

(d) a window area included as part of the envelope, the X-rays passing outwardly of the tube through the window area, the envelope region adjacent to and between the cathode focusing element and the anode including at least a portion of the window area having roughened inner surface created by mechanical abrasion followed by chemical etching of the abraded surface.

6. An evacuatable envelope for an X-ray tube, the envelope having a window area for the passage of X-rays, the envelope region being adjacent to and between a situs in the envelope for a cathode focusing element and a situs in the envelope for an anode, the region including at least a portion of the window area being treated on its inner surface by:

(a) mechanical abrasion followed by (b) acid etching.

7. The article of claim 6, wherein the acid is relatively a weak solution of hydrofluoric acid.

8. The article of claim 6, wherein the mechanical abrasion is brought about by particulate matter comprised of grit of fine to very fine grade, approximately 220 or 280 series.

9. An evacuable glass envelope for an X-ray tube, the envelope having a window area for the passage of X-rays, the envelope region being adjacent to and between a situs for a cathode focusing element and a situs for an anode, the region including at least a portion of the window area and comprising on its inner surface:

(a) a plurality of randomly disposed islands; and, (b) a plurality of tortuous canyons of varying depth intermediate the islands, the canyons having very steep walls approaching the vertical and at least some being of such narrowness and depth that a metal particle emitted by a filament in the envelope cannot strike the base of such canyon.

10. The tube of claim 1 wherein the envelope is glass.

11. An X-ray tube comprising:

(a) an evacuated glass envelope;

(b) cathode and anode assemblies mounted in spaced relationship within the envelope with the anode adapted to emit X-rays upon bombardment with an electron beam emitted by the cathode;

(c) the envelope having an area near both the anode and the cathode including at least a portion of a window area through which X-rays are emitted which develops a negative charge when in use;

(d) the inner surface of the envelope in such area being textured in the form of a series of islands separated by canyons having relatively steep and closely spaced walls, the depths of at least some of the canyons being such that a metal particle emitted by the filament when the tube is in use will strike either an island or an upper wall of a canyon rather than the base of a canyon such that the bases of at least some of such canyons will remain sufficiently free of metal deposits to electrically isolate metal deposits on the islands from one another, whereby electrical flow in such area through collected metal deposits on an inner wall of the tube which would cause premature tube failure is prevented.

12. In the manufacture of an X-ray tube having a glass envelope, the improved manufacturing process comprising:

(a) treating the inner surface of the envelope in and around an area through which X-rays will be emitted during use to create conditions which will produce markedly uneven acid etching rates;

(b) thereafter acid etching the treated area until a series of islands with relatively deep and narrow canyons therebetween are produced; and, (c) continuing the etching until the depths of the canyons is such that a line of trajectory from a filament to the treated area of the envelope cannot reach the base of at least some of the canyons without first striking at least one of the islands.

13. The process of claim 12 wherein the treating of the area is accomplished by sandblasting the area prior to acid etching.

* * * * *